United States Patent [19]

Boggs et al.

[11] Patent Number: 4,470,553

[45] Date of Patent: Sep. 11, 1984

[54] INLINE WINDER

[75] Inventors: Beryl A. Boggs, Richmond, Va.; Mandayam C. Narasimhan, Seekonk, Mass.

[73] Assignee: Allied Corporation, Morris Township, Morris County, N.J.

[21] Appl. No.: 312,435

[22] Filed: Apr. 23, 1981

Related U.S. Application Data

[63] Continuation of Ser. No. 067,088, Aug. 16, 1979, abandoned.

[51] Int. Cl.[3] ..... B65H 54/00; B65H 59/00; B65H 77/00

[52] U.S. Cl. ..... 242/25 R; 242/45; 242/47

[58] Field of Search ..... 242/25 R, 25 A, 18 A, 242/45, 47

[56] References Cited

U.S. PATENT DOCUMENTS

| | | | |
|---|---|---|---|
| 3,082,967 | 3/1963 | Hyprath et al. | 242/25 A |
| 3,148,841 | 9/1964 | Hollingsworth et al. | 242/25 A |
| 3,152,768 | 10/1964 | Astrom | 242/25 A |
| 3,193,209 | 7/1965 | Hambach | 242/45 X |
| 3,583,650 | 6/1971 | Zaborovsky | 242/25 A |
| 3,701,491 | 10/1972 | Brown | 242/25 A |
| 3,856,513 | 12/1974 | Chen et al. . | |
| 3,938,583 | 2/1976 | Kavesh . | |
| 4,116,394 | 9/1978 | Smith et al. | 242/25 R |
| 4,142,571 | 3/1979 | Narasimhan . | |
| 4,146,376 | 3/1979 | Beckman et al. . | |
| 4,239,187 | 12/1980 | Boggs et al. | 242/25 R |

FOREIGN PATENT DOCUMENTS

| | | | |
|---|---|---|---|
| 2729303 | 1/1979 | Fed. Rep. of Germany | 242/25 A |
| 1380550 | 10/1964 | France | 242/25 A |

OTHER PUBLICATIONS

Noodleman, S., Torque Motors and Brakes, Reprinted from Product Engineering, Apr., 1957.

Graham Company, AC Adjustable Frequency Drive, Sep., 1978.

*Primary Examiner*—Stanley N. Gilreath

*Attorney, Agent, or Firm*—Paul Yee; Ernest D. Buff; Gerhard H. Fuchs

[57] ABSTRACT

An inline winder is provided for taking-up a rapidly advancing filament, especially a glassy alloy filament of indefinite length at constant speed directly from a high speed continuous forming process without tension isolation. The winder is inherently load-following and thus eliminates the need for any complex feedback control system. The winder comprises a winding reel rotatively driven by a synchronous-hysteresis electrical motor and selection means for independently adjusting voltage and frequency input to the motor. The method of using the winder comprises preadjusting the frequency input to initially synchronize winder and filament speeds and preadjusting voltage input to select winding torque and initial winding tension. A transfer device is also disclosed wherein winding is transferred uninterruptedly from a wound, rotating reel to an empty, rotating wheel.

6 Claims, 6 Drawing Figures

INLINE WINDER

This is a continuation of application Ser. No. 067,088 filed Aug. 16, 1979, now abandoned.

DESCRIPTION

Background of the Invention

This invention relates generally to the inline winding of a rapidly advancing filament directly from a continuous forming process and specifically to the inline winding of a glassy alloy filament directly from a continuous casting process.

Glassy alloys are of considerable technological interest owing to their extraordinary physical properties as compared to the properties characterizing the polycrystalline form of such alloys. The term "glassy alloy" is intended to refer to metals and alloys that are rapidly quenched from a liquid state to a substantially amorphous solid state, typically having less than about 50% crystallinity, and is considered to be synonymous with such terms as "amorphous metal alloy" and "metallic glass". Glassy alloys are well documented in the literature. Representative examples are shown in U.S. Pat. No. 3,856,513 "Novel Amorphous Metals . . . " issued Dec. 24, 1974 to H. Chen and D. Polk, hereby incorporated by reference. For an extensive background, see "Metallic Glasses", American Society for Metals (1978).

In the production of glassy alloy continuous filaments, typically an appropriate molten alloy is quenched at extreme quench rates, usually at least about $10^5$° C. per second, by extruding the molten alloy from a pressurized crucible through an extrusion nozzle onto a high speed rotating quench surface, as is representatively shown in U.S. Pat. No. 4,142,571 for "Continuous Casting Method for Metallic Strips" issued Mar. 16, 1979 to M. Narasimhan, hereby incorporated by reference. Such filaments are necessarily thin, typically about 25 to 100 microns, owing to the extreme heat transfer requirements to prevent substantial crystallization, though considerable selectively may be exercised respecting the transverse dimensions and cross-section of the filament. Thus, the term "filament" is intended to include strips, narrow and wide, as well as wire-like filaments.

It is commercially desirable to wind the filament inline with its continuous casting process. However, successful inline winding of glassy alloy filaments is made difficult by several aspects. First, linear casting speeds are necessarily high, typically 1,000 to 2,000 meters per minute (37 to 75 miles per hour), as required to achieve the extreme quench rates discussed above. Second, tension isolation between the inline winder and the continuous casting process, as representatively shown in U.S. Pat. No. 3,938,583 issued Feb. 17, 1976 and hereby incorporated by reference, may produce objectionable surface striation and blemishing on the nascent hot filament, thereby undesirably inducing a high degree of directionality in the physical properties of the glassy alloy. Third, winding tension must be low so as not to disturb the nascent filament in the delicate quench zone as molten alloy is extended onto the rotating quench wheel.

Thus, to wind glassy alloy filament inline with its continuous casting process without tension isolation, the inline winder must provide extremely close speed matching of the winding surface with the rapidly advancing filament. Further, since the filament is wound onto a winding wheel, the diameter of the wound package will gradually increase; and, as the diameter increases, the rotational speed of the winder must be correspondingly decreased to maintain a constant speed winding surface.

The conventional approach in providing for constant speed inline winding relies upon complex feedback control systems, as representatively shown in U.S. Pat. No. 4,146,376 "Microcomputer Controlled Winder" issued Mar. 27, 1979 to J. Beckman and J. Lonberger. The present invention provides a simple and relatively inexpensive alternative for taking-up a rapidly advancing filament by utilizing a winder that is inherently load-following, thereby eliminating the need for any complex winding speed and torque controller.

SUMMARY OF THE INVENTION

The present invention takes advantage of the operating characteristics of a conventional synchronous-hysteresis (SH) electrical motor, both in its normal and abnormal operating modes, to provide in simple and inexpensive fashion a load-following inline winder, especially suited for taking-up a glassy alloy filament advancing at constant speed directly from a sensitive, high speed continuous casting process. SH motors as normally used operate at constant rotational speed in spite of a varying torque load (the synchronous mode). However, an abnormal operating mode (the pull-down mode) is encountered upon the load torque reaching an upper limit (the pull-down torque) at which point the motor slows down smoothly while continuing to exert a substantially constant torque (the pull-down torque). Both operating modes are important in the present invention.

In the initial stage of taking-up a continuous filament advancing at constant speed onto a reel, the motor operates in its synchronous mode whereby close speed matching of the peripheral speed of the core of the reel with filament speed is obtained by selectively preadjusting the frequency input to the motor. As winding begins, the radius of the winding increases; thus, the constant speed filament immediately exerts a load torque on the motor tending to slow the rotational speed of the motor. Upon the load torque quickly reaching the value of pull-down torque, the rotational speed of the motor begins to gradually slow in correspondence with the gradually increasing winding radius. However, during this pull-down stage in the winding sequence, the motor continues to exert a substantially constant output torque (pull-down torque) which is selectively predetermined according to the voltage input to the motor. Thus, there is not the usual dramatic tension increase on the filament during pull-down (winding) as in the uncontrolled winding situation with the result that the delicate casting operation is not disturbed. Further, any need for tension isolators between the winding reel and the casting process is eliminated, desirably so since the nascent, hot filament is particularly susceptible to surface blemishing and distortion.

Accordingly, the apparatus of the invention for taking-up an advancing filament at a substantially constant speed, includes the elements:

(a) a winding reel in rotative communication with a synchronous-hysteresis electrical motor having a substantially constant pull-down torque characteristic; and (b) selection means for adjusting the voltage input to the motor to select winding torque and for adjusting the frequency input to the motor to select the rotational speed of the motor at synchronous condition so as to match the speed of the filament.

So that winding of the advancing filament may be transferred uninterruptively from a wound reel to an empty, rotating reel, the apparatus may further include the elements:

(c) cut-and-grip means for simultaneously cutting and securing the advancing filament at the core of the winding reel; and (d) a pair of the winding reels symmetrically mounted on a rotatable transfer disk.

Preferably, the moment of inertia of the motor is substantially less than the moment of inertia of the reel with a full winding of the filament, and the filament has high tensile stiffness relative to the winding tension exerted by the winding torque.

The method of the invention for taking-up an advancing filament at substantially constant speed onto a winder having a winding reel driven by a synchronous-hysteresis electrical motor, includes the steps:

(a) adjusting the voltage input to the motor to select winding torque;

(b) adjusting the frequency input to the motor to select the rotational speed of the winding reel such that the peripheral speed of the core of the reel substantially equals the speed of the advancing filament; and (c) securing the advancing filament to the core of the winding reel, whereupon inline winding of the advancing filament proceeds.

So that winding of the advancing filament may be transferred uninterruptively from a wound reel to an empty, rotating reel, the method may further include the steps:

(d) upon the reel becoming nearly filled, bringing the core of an empty reel of a second such winder into contact with a segment of the advancing filament, the second winder having been preadjusted as in steps (a) and (b); then (e) simultaneously cutting and securing the advancing filament at the core of the second winder, thereby continuing to wind the advancing filament uninterruptedly; and (f) repeating indefintely steps (d) and (e) wherein the winders interchange operative status in alternating fashion.

BRIEF DESCRIPTION OF THE DRAWINGS

Further details are given below with reference to the embodiments shown in the drawings wherein.

DESCRIPTION OF THE PREFERRED EMBODIMENTS

Figure 1:
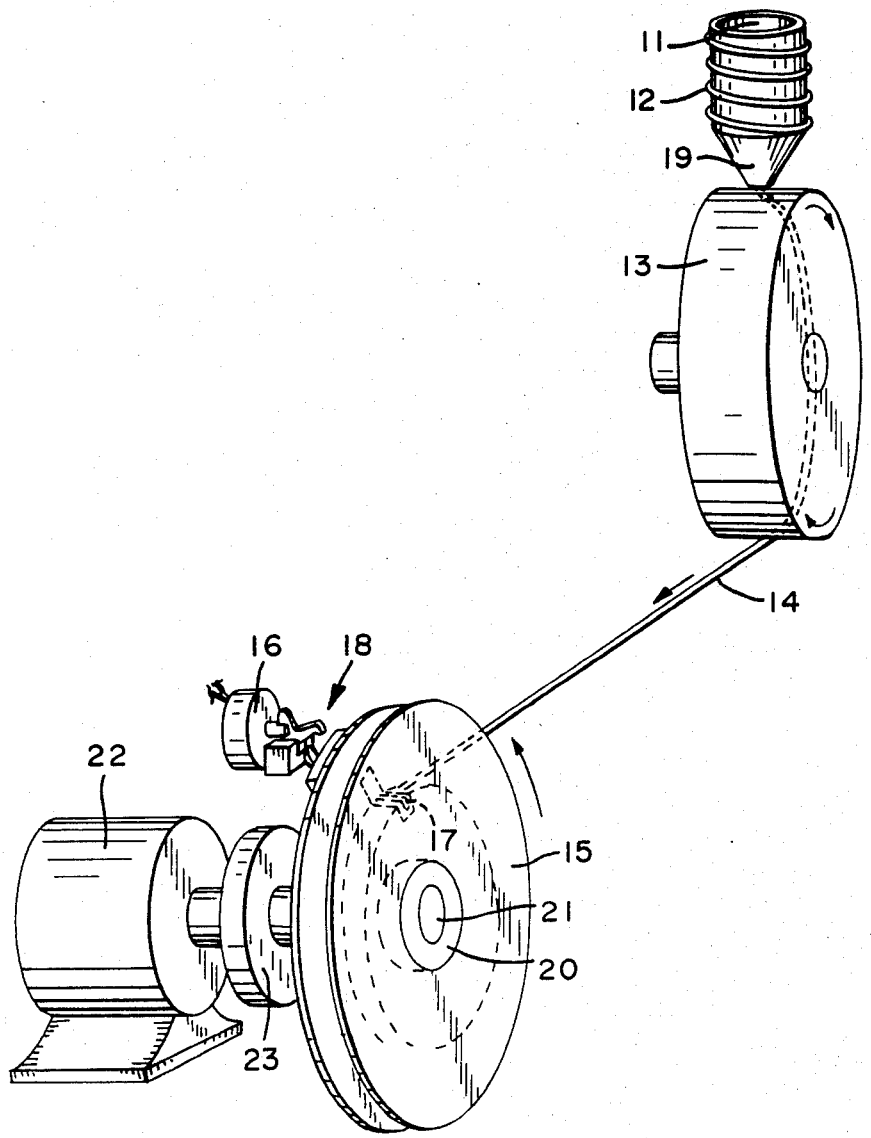
FIG. 1 shows the winder of the present invention as applied to typical prior art apparatus for the continuous casting of glassy alloy filaments, wherein molten alloy is extruded through a nozzle onto a rotating quench wheel with the solidified advancing filament being taken-up directly onto the winding reel.

Referring specifically to the drawings, in FIG. 1, typical prior art apparatus for the continuous casting of a glassy alloy filament of indefinite length is illustrated to point out the general use of the present invention. Molten alloy is contained in a crucible 11 provided with a heating element 12. Pressurization of the crucible with an inert gas causes a molten stream to be extruded through a nozzle 19 at the base of the crucible onto a rotating quench wheel 13. The solidified, moving filament 14 afer its breakaway point from the quench wheel is routed onto a winding reel 15. Reel 15 is secured with conventional chuck 20 to shaft 21 which is driven by SH motor 22 according to the present invention. Conventional braking means or transmission means 23 may optionally be interposed between motor 22 and reel 15. The rotation of quench wheel 13 is shown in the reverse casting mode; however, the present invention may readily be applied to the forward casting mode. Monospiral winding is shown; however, the invention applied equally to traverse winding.

To initiate winding in conventional fashion, the filament is strung up by utilizing an aspirator (not shown) whereby the leading portion of the advancing filament is drawn through an aspirating nozzle. An operator then manipulates the aspirator to lay the advancing filament onto the core of the winding reel, rotating at a speed approximately matching that of the advancing filament. A trigger device 16, such as a photoelectric sensor and solenoid, then releases a spring loaded, pivotal gripping element 17 associated with the winding reel to cut and secure the advancing filament 14 to the reel 15, whereupon winding proceeds inline with the casting process. Representative examples of such cut-and-grip apparatus are shown in U.S. Pat. No. 4,116,394 "Moving Filament Gripping Mechanism" issued Sept. 26, 1978 to R. Smith et al., hereby incorporated by reference. Upon the winding reel becoming filled, the advancing filament may be cut and transferred to an empty, rotating reel by the transfer device discussed below.

Figure 2:
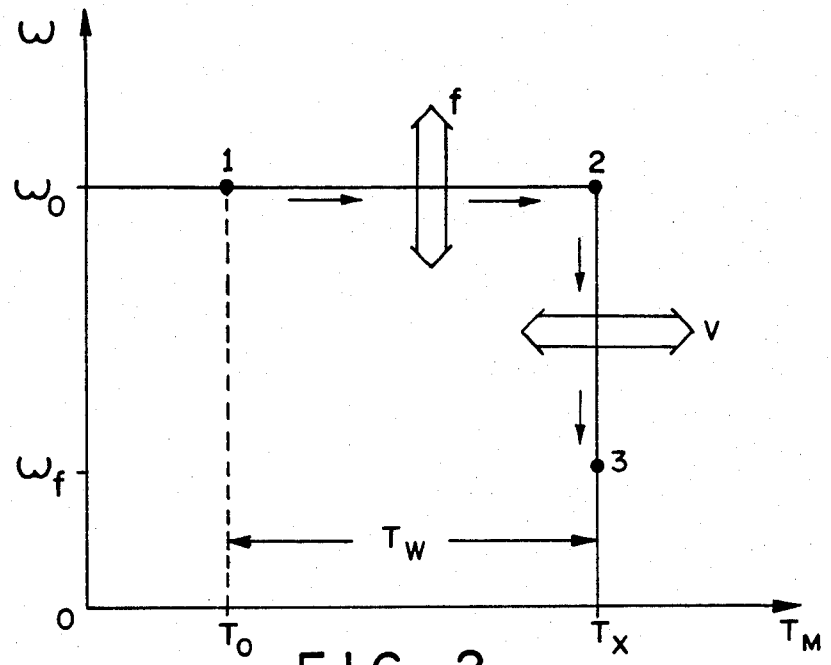
FIG. 2 illustrates an idealized torque-versus-speed curve that is characteristic of SH electrical motors.

SH electrical motors are noted for their rather unusual operating characteristics in that rotational speed remains constant (synchronous) over a wide range of load torque and also in that as the motor is pulled down from synchronous speed under excessive load torque, the motor continues to operate with a substantially constant torque output. In FIG. 2, the idealized form of the characteristic curve for SH motors is illustrated (rotational speed, w, vs. motor torque, $T_m$). The synchronous speed ($w_o$) is selectable according to the frequency (f) of the voltage source for the motor, and the pull-down torque ($T_x$) is selectable according to the voltage magnitude (V) of that source. The motor maintains the synchronous speed as the motor is loaded from a no load condition ($T_m=0$) up to the pull-down torque ($T_m=T_x$). With further increasing load, the motor is pulled down smoothly from synchronous speed while the motor torque remains substantially constant.

The general use of this type of motor for restrained winding (constant linear winding speed) may be understood with reference to a winding cycle. First, synchronous rotational speed ($w_o$) is established as corrsponding to the linear speed of the advancing filament. By adjusting the frequency (f) input to the motor, the tangential speed of the core of the winding reel can be set to equal that of the advancing filament. Allowance is made for thermal contraction of the filament as it cools in traveling from the casting zone to the winder. As the winder rotates at synchronous speed ($w_o$), the motor will develop sufficient torque to match frictional and windage loads. This no-load condition is shown at point 1 with the motor developing the corresponding no-load torque ($T_o$). Upon the advancing filament being secured to the winding surface, the winder is subjected to a winding load almost immediately since the speed of the winding surface is restrained to match the constant filament speed as the wound radius begins to increase. As the motor attempts to maintain synchronous speed ($w_o$), point 2 is reached virtually instantaneously thereby establishing an initial winding tension in the filament to maintain tautness. It is noted that for restrained winding, the winding tension is typically substantially less than the tensile stiffness of the filament (so that elongation per unit length of the filament during winding is low). Winding torque ($T_w$) at point 2 is shown as the torque difference between no-load torque ($T_o$) and pull-down torque ($T_x$). The magnitude of the pull-down torque ($T_x$) is selected by adjusting the voltage magnitude (V) input to the motor. In the next phase as winding proceeds, the rotational speed continues to decrease with increasing wound radius since the filament speed is substantially constant. The motor, however, continuous to operate while developing the pull-down torque (substantially). Eventually, the winding end-point is reached at final rotational speed ($w_f$) as shown at point 3. It is preferred that the motor have a low moment of inertia relative to the overall winder inertia in the fully wound configuration to promote the winder responding quickly in a substantially load-following manner during pull-down (winding) such that the tangential speed of the winding surface closely follows the filament speed.

As an illustrative example, a winder of the present invention utilizes a 40.6 cm diameter monospiral winding reel having a 20.3 cm diameter core that is rotatively driven by a 1/5 horsepower SH motor (Electric Indicator Company, Norwalk, Conn.) to take-up an advancing glassy alloy filament directly from a continuous casting wheel. The glassy alloy filament is of an iron-boron compositional base (e.g. U.S. Pat. No. 4,036,638 issued July 19, 1977) and has a rectangular cross-section of 1.27 cm width and about 50 microns thickness. Casting speed of the filament is substantially constant at about 1150 meters per minute. The hot filament thermally contracts about 2%, as it travels from the quench wheel to the winding reel, so that the speed of the filament at the winder is about 1125 meters per minute. The line frequency to the motor is adjusted by conventional means such as a variable frequency and voltage power supply, to about 58.7 cps to establish synchronous speed at 1762 RPM which corresponds to a peripheral speed at the core of the reel that equals the speed of the advancing filament. The line voltage to the motor is adjusted by conventional means such as a variable frequency and voltage power supply, to about 230 volts to establish pull down torque at about 9.2 cm-kg. Suitable power supplies include an AC adjustable frequency drive manufactured by Graham Company, a unit of Stowell Industries, Menomonee, Wis. Initial winding torque is about 75% of this value or 6.9 cm-kg, allowing for frictional and windage losses, producing an initial winding tension of 0.68 kg, sufficient to suppress flatter of the filament in its span between the quench wheel and the winding reel. This winding tension produces a tensile stress in the filament of about 107 kg/cm$^2$, which is much less than the tensile modulus of the glassy alloy. The pull-down characteristic may be slightly positive, e.g. a 20% smooth increase in torque during pull-down, to approximately compensate for increased frictional loss of the reel during winding. To initiate winding, the leading segment of the advancing filament is directed from the quench wheel to the winding wheel using a conventional string-up aspirator to contact the filament with the rotating core of the reel thereby triggering the cut-and-grip mechanism which secures the filament to the rotating core. Inline winding then proceeds for about 1.7 minutes with the wound radius increasing from the core to fill the reel and correspondingly with the reel speed smoothly decreasing from synchronous speed to about 880 RPM, as restrained by the constant speed filament. Winding tension generally decreases as an inverse function of the wound radius, the extent being somewhat dependent upon inertial characteristics of the wound filament on the reel. For this example, final winding tension would be about 60% of the initial winding tension. Generally, winding tension reduction in the course of winding a reel with a dense filament is desirable to avoid collapsing the chuck and making removal of the wound reel difficult. Winding is then transferred uninterruptedly to an empty, rotating winder, preadjusted to the synchronous condition, according to the transfer device discussed below.

Figure 3A:
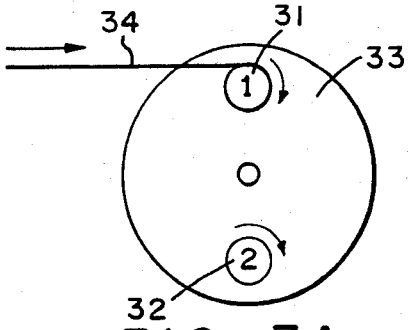
FIGS. 3A through 3D show an operating sequence of an embodiment of the present invention, wherein two winders are symmetrically mounted on a rotatable transfer disk providing for uninterrupted winding transfer of the advancing filament from a wound, rotating reel onto an empty, rotating reel.
Figure 3B:
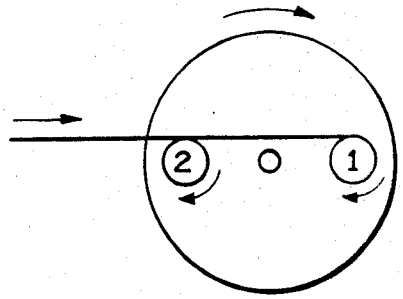
Figure 3C:
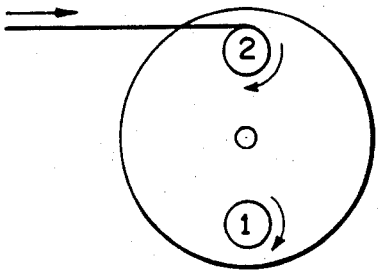
Figure 3D:
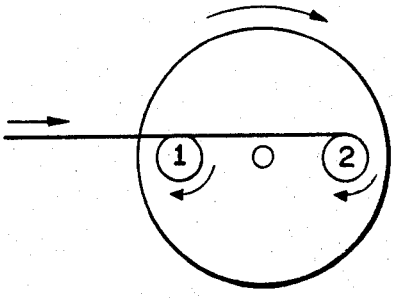

In FIGS. 3A–3D another embodiment of the invention is shown wherein two SH winders 31 and 32 are symmetrically mounted on a rotatable transfer disk 33 providing for uninterrupted winding transfer of the advancing filament 34 from a wound, rotating reel onto an empty, rotating reel. In sequence, FIGS. 3A through 3D illustrate the operation of the transfer device. In FIG. 3A, SH winder 31 is shown taking-up the advancing filament 34 as discussed above. SH winder 32 is rotating empty at synchronous condition having been preadjusted as discussed above. In FIG. 3B, as winder 31 nears completion, the transfer disk 33 is rotated 90° to contact a segment of the advancing filament 34 with the rotating core of winder 32, thereby triggering its associated cut-and-grip mechanism to cut the filament at winder 32 and to secure the advancing segment to its core. In FIG. 3C, the transfer disk 33 is rotated another 90° thereby beginning another cycle wherein the wound reel of winder 31 is replaced with an empty reel and winder 31 is brought back to synchronous speed. In FIG. 3D, the winding and transfer operation continues. Thus, winders 31 and 32 interchange operative status in an indefinitely alternating manner.

Although the present invention has been described in conjunction with preferred embodiments, it is to be understood that modifications and variations may be utilized without departing from the principles and scope of the invention as those skilled in the art will readily understand. Accordingly, such modifications and variations may be practiced within the scope of the following claims:

What is claimed is:

1. Apparatus for taking-up an advancing nascent filament from a rotating quench surface at a substantially constant speed, comprising:

(a) a winding reel which has a reel core and is in rotative communication with a synchronous-hysteresis electrical motor having a substantially constant pull-down torque characteristic; and (b) selection means for adjusting the voltage input to said motor to select winding torque and for adjusting the frequency input to said motor to select a rotational velocity of said motor which at synchronous condition provide a reel core peripheral velocity that is about 2% less than the peripheral velocity of said quench surface, said voltage and frequency being adjusted to operate said motor in its pull-down mode while said filament is being taken up on said reel, thereby providing said substantially constant filament take-up speed without a dramatic tension increase on the filament during pull-down.

2. Apparatus, as in claim 1, wherein the moment of inertia of said motor is substantially less than the moment of inertia of said reel with a full winding of said filament.

3. Apparatus, as in claim 1, further comprising:

(c) cut-and-grip means for simultaneously cutting and securing said advancing filament at the core of said winding reel.

4. Apparatus, as in claim 3, wherein said filament has high tensile stiffness relative to the winding tension exerted by said winding torque.

5. A method for taking up an advancing nascent filament from a rotating quench surface at substantially constant speed onto a winder having a winding reel which has a reel core driven by a synchronous-hysteresis electrical motor, comprising:

(a) adjusting the voltage input to said motor to select winding torque;

(b) adjusting the frequency input to said motor to select a rotational speed of said winding reel which at synchronous condition provides a reel core peripheral velocity that is about 2% less than the peripheral velocity of said quench surface;

(c) selecting said voltage and frequency inputs to operate said motor in its pull-down mode while said filament is being taken up on said reel to provide said substantially constant filament take-up speed without a dramatic tension increase on the filament during pull-down;

(d) securing said advancing filament to the core of said winding reel, whereupon in-line winding of said advancing filament proceeds.

6. A method, as in claim 5, wherein the moment of inertia of said motor is substantially less than the moment of inertia of said reel with a full winding of said filament.

* * * * *